US007665172B1

(12) United States Patent
Tran et al.

(10) Patent No.: US 7,665,172 B1
(45) Date of Patent: Feb. 23, 2010

(54) SWEEPER

(75) Inventors: Phong Tran, Caledonia, MI (US); Gary A. Kasper, Grand Rapids, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 632 days.

(21) Appl. No.: 10/907,079

(22) Filed: Mar. 18, 2005

Related U.S. Application Data

(60) Provisional application No. 60/521,255, filed on Mar. 19, 2004.

(51) Int. Cl.
*A47L 11/24* (2006.01)
*A47L 11/33* (2006.01)

(52) U.S. Cl. ..... 15/41.1; 15/42; 15/52.1; 15/79.2; 15/83

(58) Field of Classification Search ..... 15/41.1, 15/42, 48.1, 52.1, 79.1, 79.2, 83
See application file for complete search history.

(56) References Cited

U.S. PATENT DOCUMENTS

| | | | | | |
|---|---|---|---|---|---|
| 391,129 | A | * | 10/1888 | Drew | 15/41.1 |
| 1,594,685 | A | | 8/1926 | Osius | |
| 1,972,870 | A | * | 9/1934 | Christesen | 15/41.1 |
| 2,101,133 | A | * | 12/1937 | Dilliard | 15/41.1 |
| 2,178,917 | A | * | 11/1939 | Pullen | 15/41.1 |
| 2,206,429 | A | * | 7/1940 | Redfearn | 15/41.1 |
| 2,235,432 | A | * | 3/1941 | Kenyon | 15/41.1 |
| 2,268,059 | A | * | 12/1941 | Parker et al. | 15/83 |
| 2,275,356 | A | | 3/1942 | Funk | |
| 2,502,403 | A | * | 3/1950 | Kircher | 15/41.1 |
| 2,670,485 | A | | 3/1954 | Gomez | |
| 3,261,046 | A | * | 7/1966 | Massaglia | 15/3.1 |
| 3,460,188 | A | | 8/1969 | Boyd | |
| 3,906,585 | A | * | 9/1975 | Mattsson | 15/349 |
| 4,207,641 | A | * | 6/1980 | Liebscher et al. | 15/41.1 |
| 4,369,539 | A | | 1/1983 | Nordeen | |
| 4,446,595 | A | * | 5/1984 | Nakada et al. | 15/365 |
| 4,484,371 | A | | 11/1984 | Patzold et al. | |
| 4,660,247 | A | | 4/1987 | Frohbieter et al. | |
| 4,701,969 | A | * | 10/1987 | Berfield et al. | 15/79.1 |
| 4,864,682 | A | | 9/1989 | Bewley, Jr. et al. | |

(Continued)

FOREIGN PATENT DOCUMENTS

| | | |
|---|---|---|
| FR | 1 442 587 | 7/1976 |

(Continued)

*Primary Examiner*—Mark Spisich
(74) *Attorney, Agent, or Firm*—McGarry Bair PC

(57) ABSTRACT

A powered floor sweeper comprises a foot assembly with a motor driven primary agitator and a pair of edge agitators coupled to wheels such that manual propulsion of the sweeper rotates the wheels and thereby the edge agitators. The sweeper includes a slip clutch mechanism to protect the primary agitator and the motor in case the agitator become jammed. Additionally, the sweeper comprises a ramp assembly along an agitator opening to help collect dirt and dust at the primary agitator. A dust bin removably mounted in an open top dust bin recess is in communication with the agitator opening and receives the dirt and dust collected at the agitator opening. Furthermore, the sweeper comprises a handle assembly having a detent mechanism that interacts with a pivot cradle in the foot assembly to retain the handle assembly in a generally vertical position.

6 Claims, 12 Drawing Sheets

U.S. PATENT DOCUMENTS

| | | | | |
|---|---|---|---|---|
| 5,920,939 | A | 7/1999 | Worwag | |
| 2005/0155169 | A1 * | 7/2005 | Cheah et al. | 15/42 |

FOREIGN PATENT DOCUMENTS

| | | | |
|---|---|---|---|
| GB | 2001240 | * | 1/1979 |
| JP | 5-123274 | * | 5/1993 |
| WO | WO 03/007776 A1 | | 1/2003 |

* cited by examiner

SWEEPER

CROSS-REFERENCE TO RELATED APPLICATIONS

This application claims the benefit of U.S. Patent Application No. 60/521,255, filed Mar. 19, 2004.

FIELD OF THE INVENTION

This invention relates to sweepers. In one aspect, the invention relates to a sweeper with a dust bin accessible from the top of the sweeper for facile removal and emptying of the dust bin. In another aspect, the invention relates to a sweeper with a powered agitator and a clutch mechanism therefor. In yet another aspect, the invention relates to a sweeper with a retractable ramp mechanism to facilitate collection of dirt and debris at the agitator opening. In still another aspect, the invention relates to a sweeper with a pivotable handle assembly having a detent that abuts a detent ramp in the foot assembly to retain the handle assembly in a generally vertical position.

DESCRIPTION OF THE RELATED ART

Sweepers are well known devices for removing dirt, dust, and other debris from a floor surface. Typically, sweepers comprise a foot assembly with at least one primary agitator, such as a horizontal axis brush roll, driven by manual propulsion or some other means, such as a motor. An exemplary powered floor sweeper wherein a rotating sweeper brush is rotated by a direct current electric motor is disclosed in U.S. Pat. No. 4,369,539 to Nordeen. In Nordeen '539, a cavity at a rear end of the sweeper houses a DC motor and a battery supply to provide power for the motor. One problem associated with powered agitators is that the motor, the agitator, and/or the mechanism for coupling the motor to the agitator can be damaged if the agitator becomes jammed or is otherwise unable to rotate.

In addition to the primary agitator, floor sweepers can include edge agitators, also driven by manual propulsion or some other means. An exemplary floor sweeper having, in addition to its main brush roller, one or more auxiliary brushes for sweeping debris into the path of the main brush is disclosed in U.S. Pat. No. 3,978,539 to Yonkers. In Yonkers '539, a pair of auxiliary brushes are located at the forward corners of the sweeper housing and rotate in a direction to throw debris along the edge of the sweeper housing towards the middle of sweeper housing where the debris can be picked up by the main rotating brush. Other patents disclosing edge brushes include, for example, U.S. Pat. Nos. 500,976 to Tangenberg; 3,750,215 to Liebscher, 3,818,532 to Leifheit et al.; and 4,484,371 to Pätzold et al.

To further facilitate collection of debris, some sweepers comprise a wiper strip or ramp positioned along the opening through which the primary agitator extends for agitating the surface to be cleaned. The wiper strip contacts the surface to be cleaned to prevent the debris from passing under the sweeper during forward movement thereof. The abovementioned Nordeen '539 patent includes such a wiper strip, and another exemplary wiper strip is disclosed in U.S. Pat. No. 2,275,356 to Frank. The position of the Frank '356 wiper strip relative to the surface to be cleaned can be adjusted manually by the operator through a lever. An operator would advantageously desire to raise the wiper strip during reverse movement of the sweeper so that the wiper strip does not push the debris away from the agitator opening. However, manual movement of the wiper strip can be inconvenient for the operator, especially if the operator reciprocally moves the sweeper in forward and rearward directions.

Usually, the primary agitator throws the dirt, dust, and other debris into a dust bin. In some sweepers, the dust bin is a cavity that can be emptied by opening a panel in the sweeper housing. Other sweepers comprise a separate dust bin mounted in the sweeper housing, and the dust bin can be removed from the sweeper for emptying. For example, Great Britain U.S. Pat. No. 1,442,587 to Moulinex discloses a sweeper with a separate dust bin that can be removed from the sweeper housing after lifting a cover on the sweeper housing to gain access to the dust bin. Because the user has to lift the cover before removing the dust bin, the process of emptying the dust bin can be awkward, especially if the user has only one free hand.

Sweepers also comprise a handle assembly pivotally mounted to the foot assembly for moving the sweeper across the surface to be cleaned. When the sweeper is not in use, the user can rest handle assembly against a wall for storage, or the sweeper can preferably include a mechanism for retaining the handle assembly in a generally vertical storage position. Examples of such retaining mechanisms are disclosed in, for example, U.S. Pat. Nos. 5,361,447 to Ophardt; 2,057,181 to Bloom; 255,823 to Soper, 2,406,247 to Owen; 2,975,450 to Williams; 3,034,163 to Stevens; 4,168,561 to Rosendall; and 5,208,935 to Jailor. An optimal retaining mechanism is simple, reliably holds the handle assembly in the generally vertical position, and can be easily manipulated by the user to move the handle assembly away from the vertical position.

Customarily, the sweeper handle assembly comprises an elongated stick-like portion that can be grasped by a user while standing an upright position. A segmented upright pivotal handle for a vacuum cleaner is disclosed in U.S. Pat. No. 6,345,411 to Kato et al., wherein upper handle segments can be removed so that the vacuum cleaner can be utilized as a hand held unit in addition to a conventional upright unit.

SUMMARY OF THE INVENTION

A sweeper according to one embodiment of the invention comprises a foot housing that forms a dust bin cavity with an open top and an agitator aperture on a bottom portion of the foot housing and that opens toward the surface to be cleaned; a dust bin mounted in the open top dust bin cavity such that the dust bin can be inserted into and removed from the dust bin cavity from above the foot housing, the dust bin having a dust bin inlet in communication with the agitator aperture, and an agitator assembly mounted to the foot assembly and positioned at least partially in the agitator aperture to throw dirt from the surface to be cleaned into the dust bin through the dust bin inlet.

In one embodiment, the dust bin further comprises a diverter that distributes dirt within the dust bin when the dirt enters the dust bin through the dust bin inlet. The dust bin further comprises spaced front and rear walls, wherein the dust bin inlet is formed in the front wall and the diverter is formed in the rear wall. The diverter comprises an arcuate wall section that protrudes inward toward the front wall. The arcuate wall section is located at the center of the rear wall.

In another embodiment, the dust bin further comprises an integrally molded grip.

A sweeper according to one embodiment of the invention comprises a foot housing that forms a dust bin cavity and an agitator aperture in a bottom portion of the foot housing and that opens toward the surface to be cleaned; a dust bin mounted in the dust bin cavity and having a dust bin inlet in communication with the agitator aperture, an agitator rotatably mounted to the foot assembly and positioned at least partially in the agitator aperture to throw dirt from the surface to be cleaned into the dust bin through the dust bin inlet; a motor mounted in the foot assembly and coupled to the agitator to rotate the agitator; and a clutch assembly mounted to the agitator. The clutch assembly comprises a pulley coupled to the motor for rotation therewith; a clutch coupled to the agitator for rotation therewith, the clutch and the pulley having complementary surfaces, wherein the complementary surfaces comprise ramped slip clutch surfaces; and a biasing member positioned between the clutch and the agitator to bias the clutch towards the pulley to mate the complementary surfaces whereby, during normal operation conditions, rotation of the pulley by the motor rotates the clutch and the agitator as the complementary surfaces of the pulley and the clutch mate and rotate together and, during conditions where rotation of the agitator is prevented, the surface of the clutch slips relative to the complementary surface of the pulley while the motor rotates the pulley, the pulley pushes the clutch against the bias of the biasing member, and the biasing member continues to bias the clutch towards the pulley.

In one embodiment, the agitator comprises a brush roll rotatably mounted on a horizontally oriented axle, and the clutch assembly is rotatably mounted on the axle adjacent the agitator. The motor comprises a drive shaft with a drive gear fixedly mounted to the drive shaft, and the drive gear is coupled to the pulley by a belt. The motor is powered by a battery. The complementary surfaces can comprise multiple ramped surfaces. For example, the multiple ramped surfaces can be arranged circumferentially around the pulley and the clutch.

A sweeper according to another embodiment of the invention comprises a foot housing that forms a dust bin cavity and an agitator aperture in a bottom portion of the foot housing and that opens toward the surface to be cleaned; a dust bin mounted in the dust bin cavity and having a dust bin inlet in communication with the agitator aperture, an agitator rotatably mounted to the foot assembly and positioned at least partially in the agitator aperture to throw dirt from the surface to be cleaned into the dust bin through the dust bin inlet; a retractable ramp movably mounted to the foot housing and positioned at an acute angle to the vertical along an edge of the agitator aperture for movement toward and away from the surface to be cleaned for contact with the surface to be cleaned at least when the retractable ramp is in an extended position; and a pair of wheels rotatably mounted to the foot housing for rotational motion in a forward and rearward direction and to support the foot housing for movement in a forward direction and a rearward direction, the wheels are coupled to the ramp assembly for moving the ramp assembly between the retracted and extended positions in response to the rotation of the wheels between the rearward and forward direction.

In one embodiment, the ramp assembly comprises a fixed ramp mounted to the foot assembly and a retractable ramp movable relative to the fixed ramp when the ramp assembly moves between the retracted and extended positions. In one embodiment, at least one of the fixed ramp and the retractable ramp is planar. In another embodiment, at least one of the fixed ramp and the retractable ramp is arcuate. In one embodiment, the retractable ramp is made of a resilient material.

In another embodiment, the agitator aperture is defined between front and rear edges, and the ramp extends along the rear edge of the agitator aperture.

In another embodiment, the ramp assembly moves to the retracted position when the wheels rotate in a reverse direction. The ramp assembly moves to the extended position when the wheels rotate in a forward direction.

In yet another embodiment, the retractable ramp is mounted to float over the surface to be cleaned, picking up dirt and debris when the sweeper moves in a forward direction and riding over the floor surface when the sweeper moves in a reverse direction.

Still further according to the invention, a floor cleaning apparatus comprises a housing that forms an agitator aperture in a bottom portion of the housing and that opens toward the surface to be cleaned; a dust collector associated with the housing and in open communication with the agitator aperture; an agitator rotatably mounted to the housing and positioned at least partially in the agitator aperture to move dirt from the surface to be cleaned to the dust collector; and a retractable ramp positioned at an acute angle to the vertical along an edge of the agitator aperture for movement toward and away from the surface to be cleaned for contact with the surface to be cleaned at least when the retractable ramp is in an extended position.

In one embodiment, a fixed ramp mounted to the housing and the retractable ramp is movable relative to the fixed ramp. Further, at least one of the fixed ramp and the retractable ramp is planar. In an alternative embodiment, at least one of the fixed ramp and the retractable ramp is arcuate. Further, the retractable ramp can be made of a resilient material.

Typically, the agitator aperture is defined between front and rear edges and the retractable ramp extends along the rear edge of the agitator aperture. In one embodiment, the retractable ramp moves to the retracted position when the wheels rotate in a reverse direction. Furthers the retractable ramp assembly moves to the extended position when the wheels rotate in a forward direction.

DESCRIPTION OF THE PREFERRED EMBODIMENT

Figure 1:
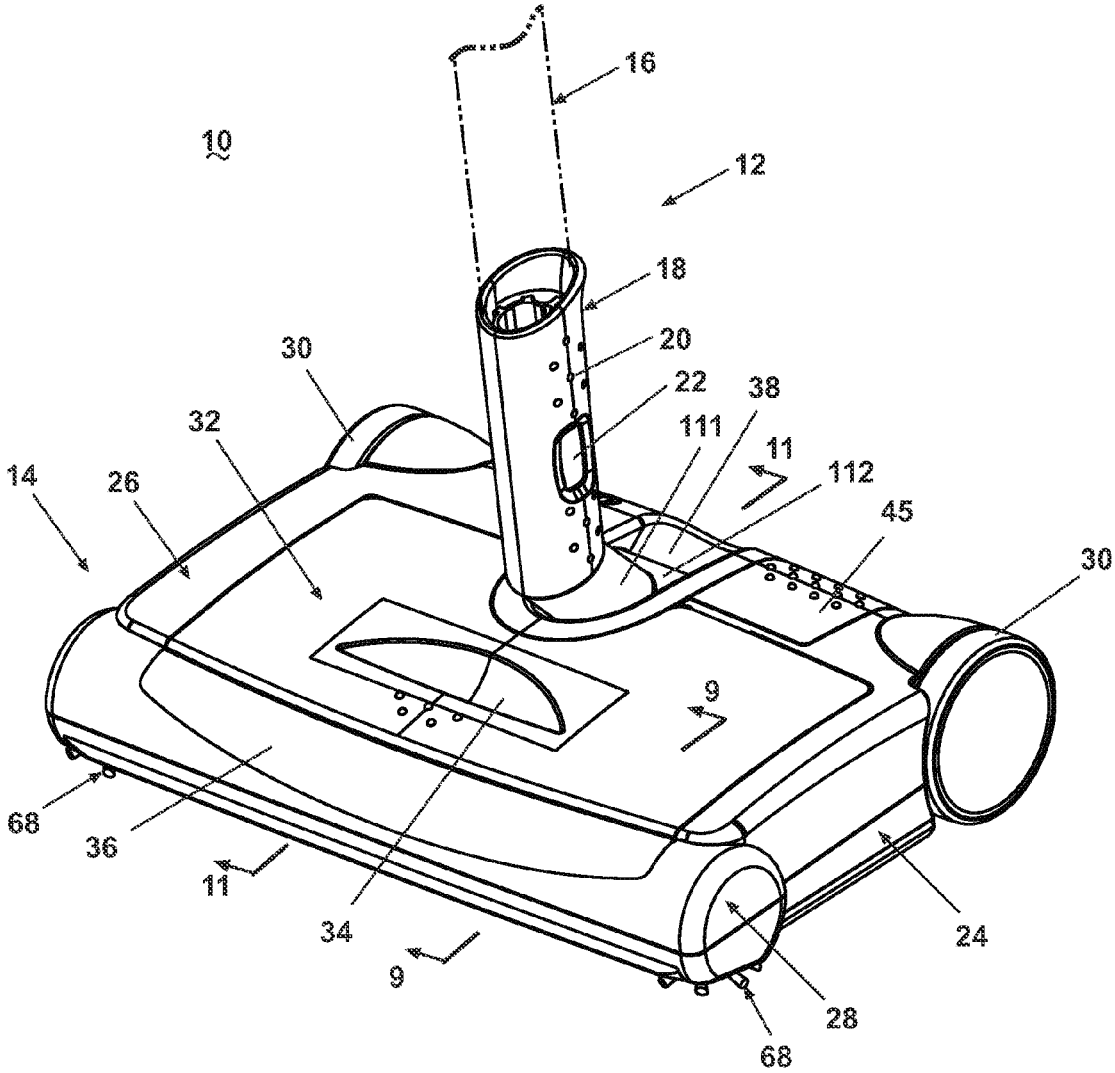
FIG. 1 is a front perspective view of a powered sweeper according to the invention, wherein a pivoting handle is in a vertical position.
Figure 2:
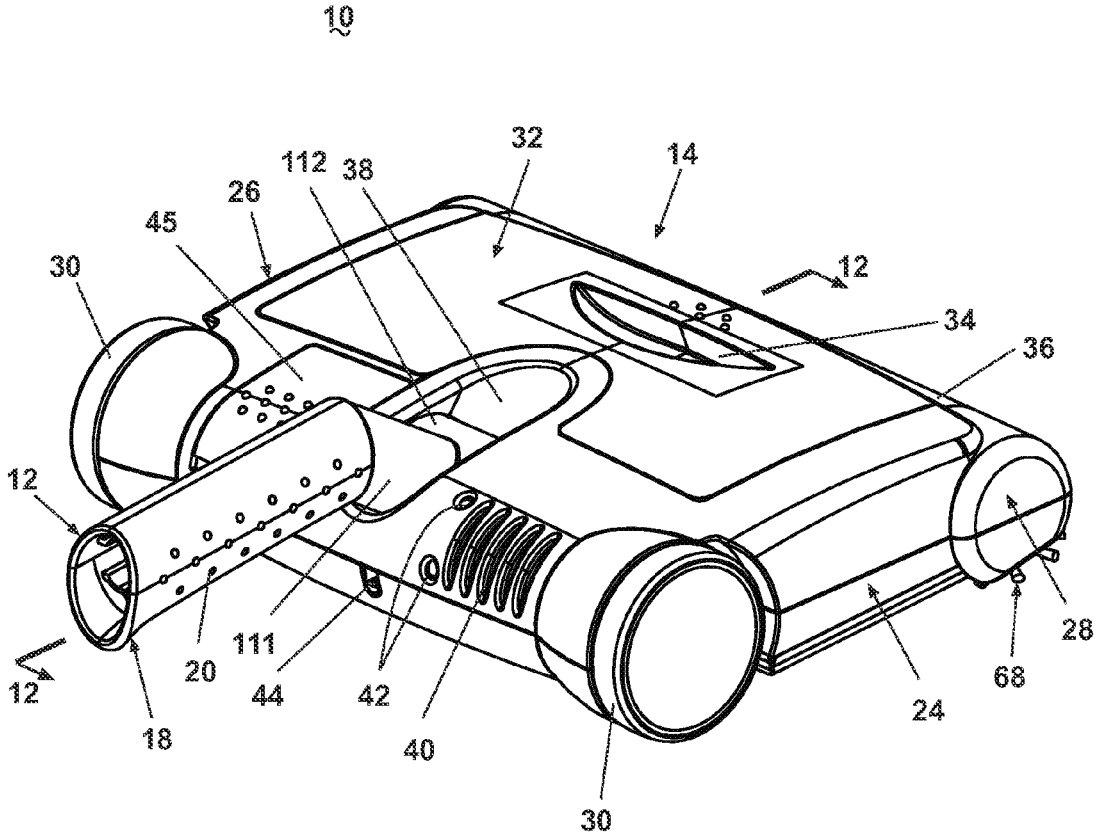
FIG. 2 is a rear perspective view of the sweeper shown in FIG. 1 with the pivoting handle in a horizontal position.

Referring to the drawings and to FIGS. 1 and 2 in particular, a powered sweeper 10 according to the invention comprises a handle assembly 12 pivotally mounted to a foot assembly 14. The handle assembly 12 comprises a plurality of upper handle segments 16, only one of which is shown in phantom in FIG. 1, and a lower handle assembly 18. The handle segments 16 are removably joined together in the manner shown, for example, in U.S. Pat. No. 6,345,411 to Kato et al., which is incorporated herein by reference in its entirety. The lower handle assembly 18 comprises a lower grip 20 and an engagement aperture 22 that removably receives a projection (not shown) of the upper handle segment 16 to secure the upper handle segments 16 to the lower handle assembly 18 in a generally linear arrangement. The powered sweeper 10 can be used in an upright mode with one or more of the upper handle segments 16 mounted to lower handle assembly 18 so that a user can stand generally upright while grasping one of the handle segments 16 for maneuvering the powered sweeper 10 over the surface to be cleaned. Alternatively, the powered sweeper 10 can be used in a hand-held mode by removing the upper handle segments 16 and grasping the lower grip 20 for manipulating the powered sweeper 10 over the surface to be cleaned. FIG. 1 depicts the powered sweeper 10 with the handle segments 16 attached to the lower handle assembly 18 for use of the powered sweeper 10 in the upright mode, and FIG. 2 depicts the powered sweeper 10 with the handle segments 16 detached from the lower handle assembly 18 for use of the powered sweeper 10 in the hand-held mode.

The foot assembly 14 comprises a lower housing 24 and an upper housing 26, which, when mated, form a cavity therebetween to house various components. A plurality of bosses 96 (FIG. 8) extend upwardly from the lower housing 24 and mate with corresponding structures (not shown) in upper housing 26, and the lower housing 24 is secured to the upper housing 26 with screws or other suitable fastening devices. The foot assembly 14 is a generally rectangular structure where, by way of reference, the lower handle assembly 18 is located at a rearward portion of the foot assembly 14 while a brush housing 28 is located at a forward end of the foot assembly 14. A pivot recess 38 is formed in the upper housing 26 to accommodate pivotal movement of the lower handle assembly 18 relative to the foot assembly 14. The pivot recess 38 accommodates pivotal movement of the handle assembly 12 between a generally vertical storage position illustrated in FIG. 1 and a generally horizontal position illustrated in FIG. 2. The foot assembly 14 is supported on the surface to be cleaned by a pair of wheels 30 are located on the rear corners of the foot assembly 14 and a set of rollers (not shown) located near the brush housing 28 on an underside of the lower housing 24.

Figure 3:
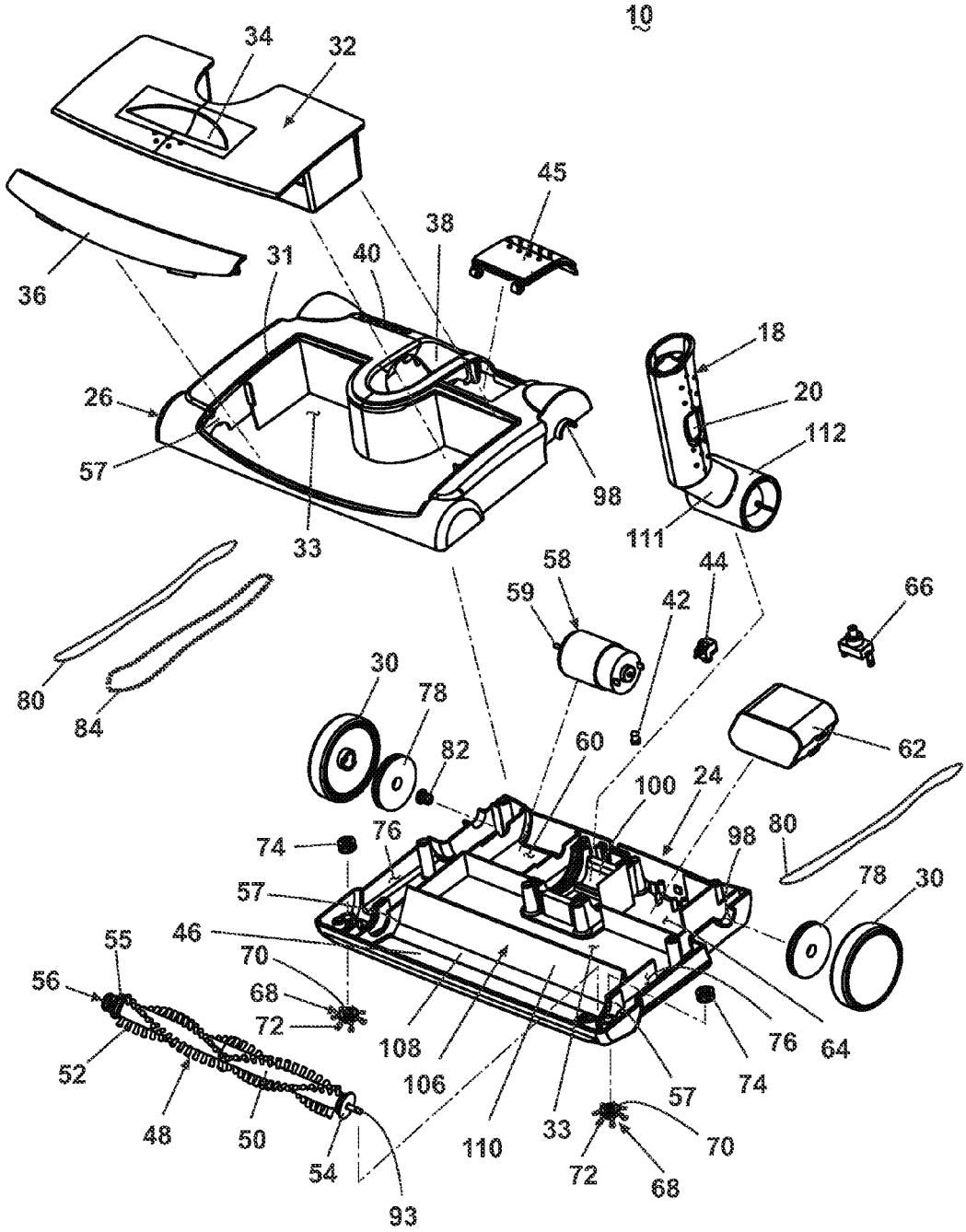
FIG. 3 is an exploded view of the sweeper shown in FIG. 1.
Figure 4:
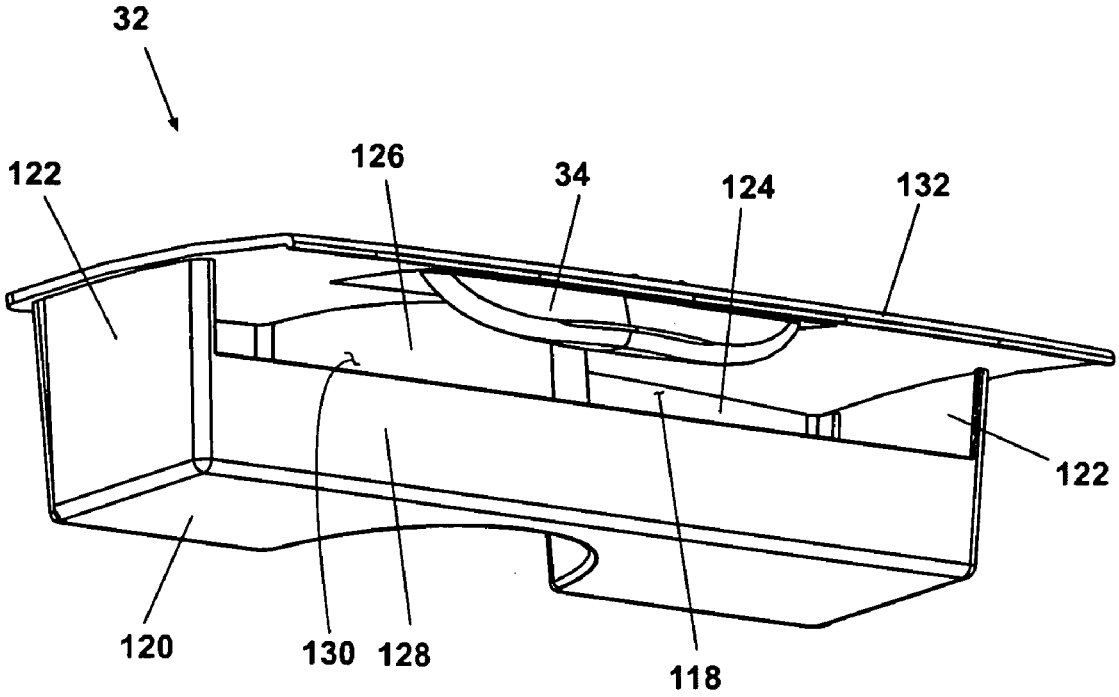
FIG. 4 is a perspective view of a dust bin from the sweeper shown in FIG. 1.
Figure 5:
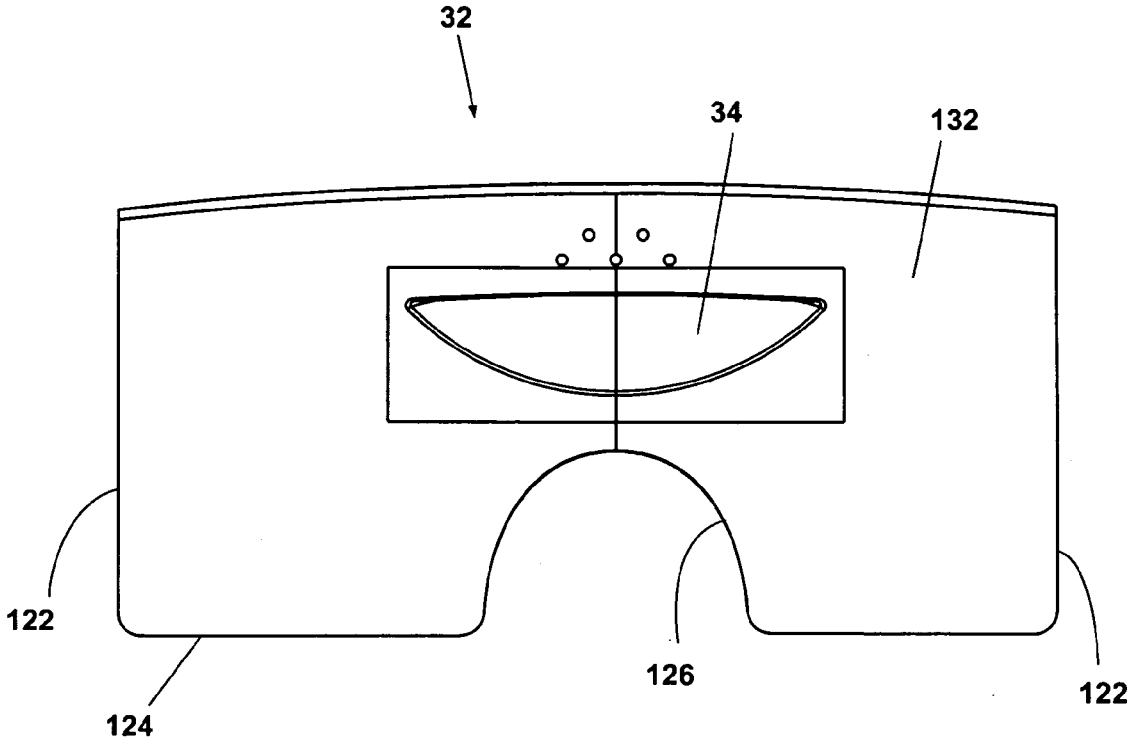
FIG. 5 is a plan view of the dust bin shown in FIG. 4.

Referring additionally to FIG. 3, the upper housing 26 and the lower housing 24 form a dust bin cavity 33 sized to removably receive a dust bin 32. The upper housing 26 has a generally centrally located aperture 31 that provides access to the dust bin cavity 33 and through which the dust bin 32 passes during insertion into the dust bin cavity 33. The dust bin 32 comprises a dust bin grip 34 to facilitate manual manipulation of the dust bin 32 by the user. To remove the dust bin 32 from the dust bin cavity 33, the user simply grasps the dust bin grip 34 and lifts the dust bin 32 in a generally upward motion away from the foot assembly 14. Referring additionally to FIGS. 4 and 5, the dust bin 32 further comprises a chamber 118 formed by a floor 120, a pair of opposing side walls 122 oriented generally perpendicular to the floor 120, and a back wall 124 that joins rear edges of the side walls 122. The back wall 124 curves inward to form an arcuate wall section 126 for accommodating pivotal movement of the lower handle assembly 18 between the vertical and the horizontal positions. The arcuate wall section 126 also functions as a debris diverter for equally distributing debris along the width of the dust bin chamber 118. The chamber 118 is also partially defined by a front wall 128 that extends upward from the floor 120 and joins front edges of the side walls 122. The front wall 128 is approximately half the height of the side walls 122 to define a dust bin inlet aperture 130 above the front wall 128 and between the side walls 122. The dust bin inlet aperture 130 is further defined by a dust bin top 132 that is fixedly attached to upper edges of the sidewalls 122 and the back wall 124. The dust bin top 132 comprises the dust bin grip 34, which is integrally formed therewith such that a space formed between the dust bin top 132 and the dust bin grip 34 is sufficient to allow fingertip grip for removal of the dust bin 32 from the foot assembly 14.

In addition to providing access to the dust bin cavity 33, the aperture 31 in the upper housing 26 extends into the brush housing 28, and the portion of the upper housing 26 that extends into the brush housing 28 is closed by a brush lens 36 preferably made of a translucent material so that the user can view a agitator assembly 48 mounted within the brush housing 28. The agitator assembly 48 will be described in more detail hereinafter.

With continued reference to FIGS. 1, 2 and 3, the upper housing 26 includes a plurality of motor exhaust apertures 40 formed in the rearward portion thereof. The motor exhaust apertures 40 communicate with a corresponding motor cavity 60 formed between the lower housing 24 and the upper housing 26. The motor cavity 60 holds a brush motor 58 has a rotatable drive shaft 59 with a brush drive gear 82 fixedly attached thereto. The brush motor 58 is powered by a portable power source in the form of a battery pack 62 located in a battery cavity 64 formed in a rearward portion of the lower housing 24. The battery pack 62 can comprise any commonly known battery type, preferably a rechargeable nickel cadmium (NiCad), nickel metal hydride (NiMH), or lithium battery. A light source, such as a light emitting diode (LED) 42, mounted to the rearward portion of the upper housing 26 and is in electrical communication with the battery pack 62 to provide to the user a visual indication of a charge condition of the battery pack 62. The LED 42 can be a single LED or can be more than one LED. When more than one LED is used, at least one LED is preferably red, and at least one other LED is preferably green. The upper housing 26 supports a pivotable switch cover 45 biased to a position where it is generally flush with the upper housing 26. The switch cover 45 is in operative communication with an electrical switch 66 located beneath the switch cover 45 such that depression of the switch cover 45 actuates the switch 66. The electrical switch 66 is located adjacent the battery pack 62 and is supported by a plurality of ribs formed in the lower housing 24. The electrical switch 66 electrically couples the brush motor 58 and the battery pack 62, and depression of the switch cover 45 either closes the electrical switch 66 to turn the brush motor 58 on or opens the electrical switch 66 to turn the brush motor 58 off. A charging jack 44 accessible from the rear portion of the foot assembly 14 interfaces with a separate, conventional electrical power transformer and power cord (not shown) to provide an electrical connection between a power source and the internal battery pack 62 to charge the battery pack 62.

Figure 6:
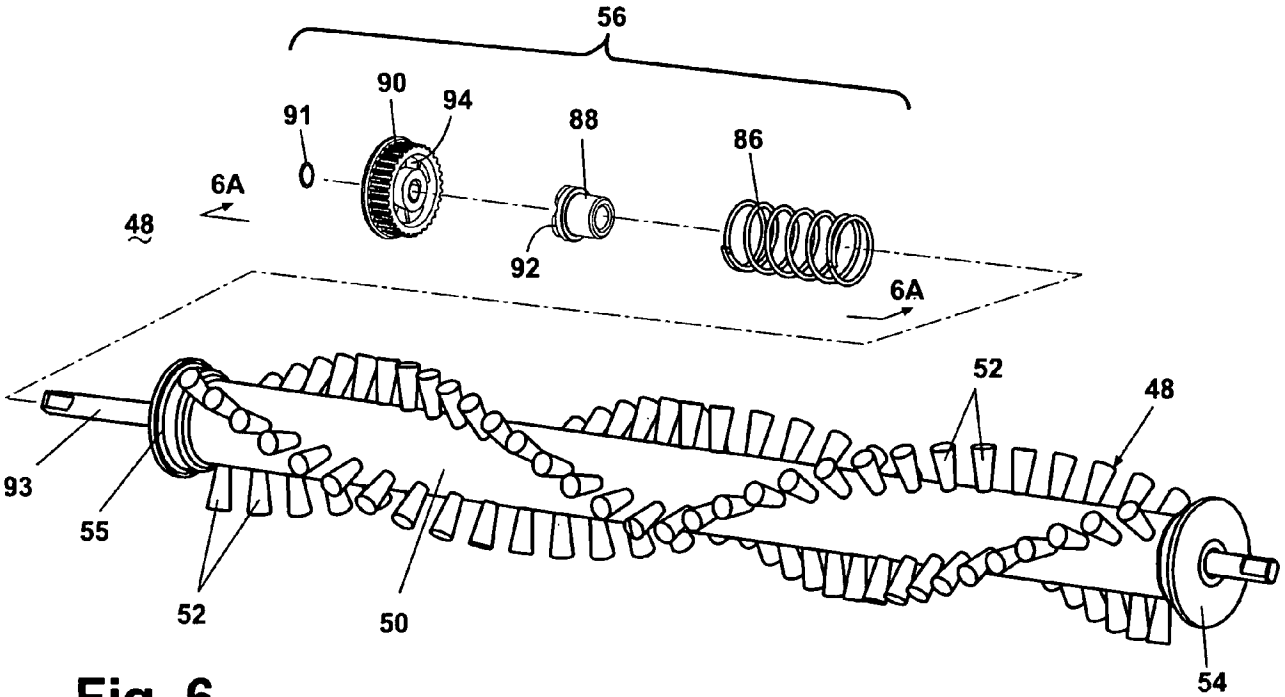
FIG. 6 is an exploded view of an agitator assembly of the sweeper shown in FIG. 1.

Referring now to FIG. 6, the agitator assembly 48 rotatably mounted in the brush housing 28 contacts the surface to be cleaned through an elongated agitator aperture 46 formed in a forward lower portion of the lower housing 24. The agitator assembly 48 comprises a support in the form of a brush dowel 50 onto which a plurality of bristles 52 are affixed in a commonly known manner. The brush dowel 50 is mounted on a horizontally oriented axle 93, and the bristles 52 extend through the agitator aperture 46 to contact and agitate the surface to be cleaned and throw dirt and dust from the agitator aperture 46 into the dust bin 32 through the dust bin inlet aperture 130. The agitator assembly 48 further comprises a first bearing 54 located on a first end of the brush dowel 50 for supporting the first end of the brush dowel 50 in the foot assembly 14 and a second bearing 55 on a second, opposite end of the brush dowel 50 for supporting the second end of the brush dowel 50 in the foot assembly 14. The first and second bearings 54, 55 are rotatably mounted between pairs of mating ribs 57 on the upper and lower housings 26, 24 of the foot assembly 14.

Figure 6A:
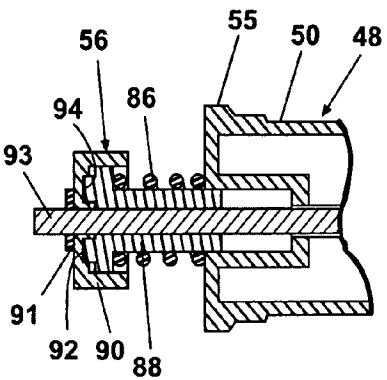
FIG. 6A is a sectional view of a clutch gear assembly taken along line 6A-6A of FIG. 6.

Referring to FIGS. 6 and 6A, the agitator assembly 48 further comprises a clutch gear assembly 56 mounted on the axle 93 adjacent the second end of the brush dowel 50. The clutch gear assembly 56 comprises a spring 86 positioned between the second bearing 55 and a clutch 88. The spring 86 biases the clutch 88 into mating contact with a clutch pulley 90, and the mating ends of the clutch 88 and the clutch pulley 90 comprise complementary first and second ramped surfaces 92, 94. The opposite end of the clutch 88 is keyed with the brush dowel 50 so that rotation of the clutch 88 induces rotation of the brush dowel 50. Furthermore, the brush dowel 50 and the clutch 88 are designed so that the clutch 88 can move axially relative to the brush dowel 50. A retaining washer 91 secures the clutch pulley 90, the clutch 88, and the spring 86 on a portion of the axle 93 that protrudes from the second end of the brush dowel 50. A brush drive belt 84 couples the clutch pulley 90 to the brush drive gear 82 so that rotation of the brush drive gear 82 induces rotation of the clutch pulley 90. During normal operating conditions, the spring 86 forces the clutch 88 into mating contact with the clutch pulley 90, whereby the first and second ramped surfaces 92, 94 mate and engage. As a result, the clutch 88 rotates with the clutch pulley 90, and the brush dowel 50 rotates with the clutch 88. Consequently, the bristles 52 agitate the surface to be cleaned through the agitator aperture 46. When rotation of the brush dowel 50 is prevented, such as when an object becomes caught in the bristles 52 and thereby prevents movement of the brush dowel 50, the first ramped surface 92 of the clutch 88 cannot rotate. At the same time, the brush drive gear 82 and the drive belt 84 continue to rotate the clutch pulley 90 and the second ramped surface 94, which rides over the non-rotating first ramped surface 92. Consequently, the first and second ramped surfaces 92, 94 disengage, and the clutch pulley 90 pushes the clutch 88 axially against the bias of the spring 86 towards the brush dowel 50. In other words, the clutch pulley 90 continues to rotate with the drive belt 84 while the clutch 88 slips relative to the clutch pulley 90. Because the clutch 88 does not rotate, the clutch 88 does not impart a rotational force to the brush dowel 50. This action prevents damage to the brush motor 58, the brush drive belt 84, and the brush dowel 50.

Figure 7:
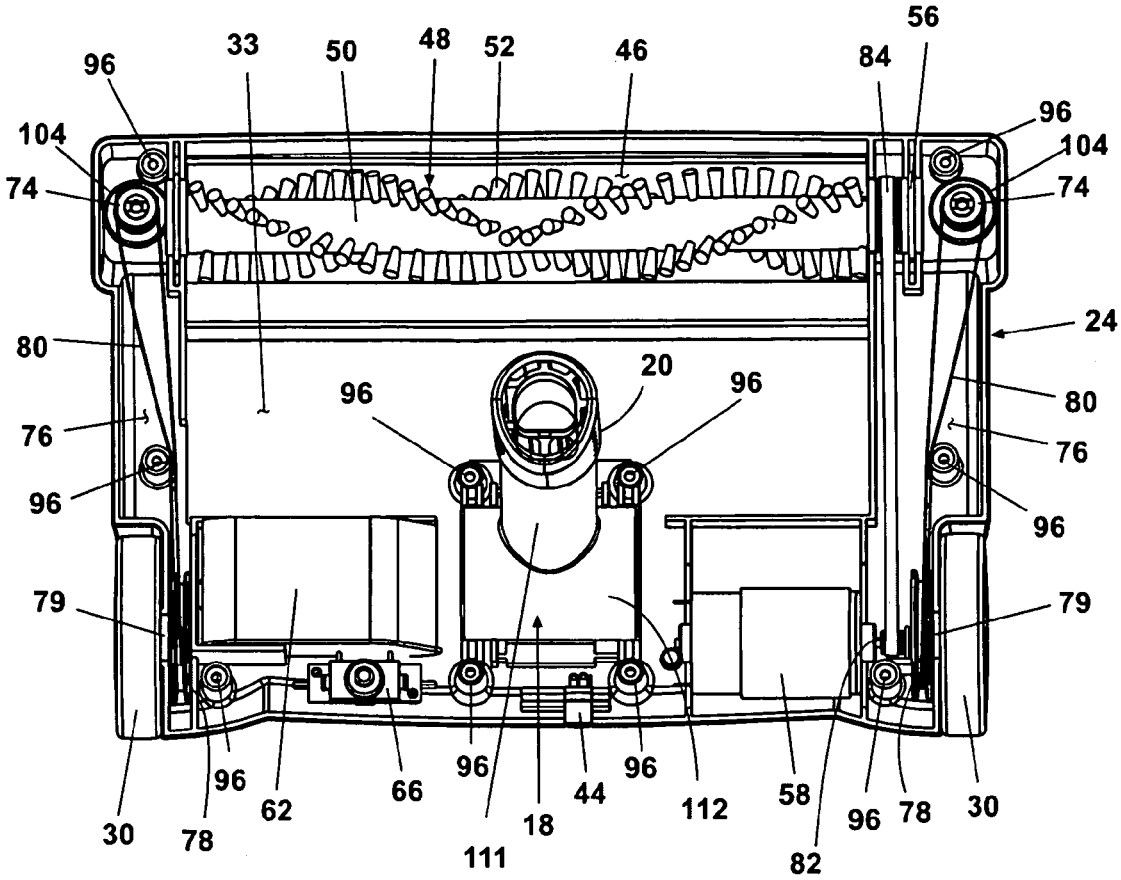
FIG. 7 is a plan view of the sweeper shown in FIG. 1 with an upper housing, a brush lens, and the dust bin removed.
Figure 8:
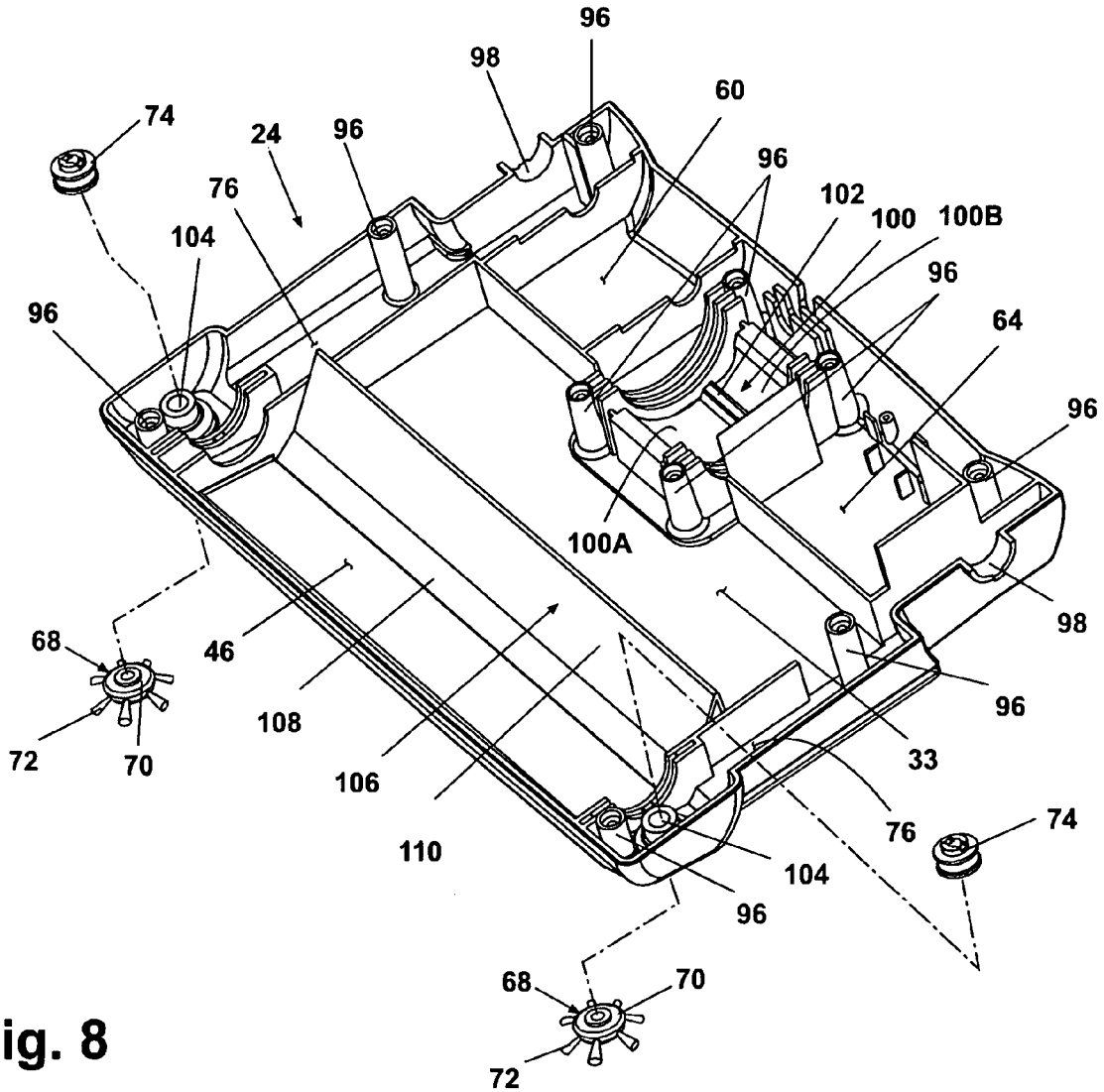
FIG. 8 is a perspective view of a lower housing of the sweeper shown in FIG. 1.

Referring now to FIGS. 3, 7, and 8, the powered sweeper 10 further comprises corner brush assemblies 68 mounted in corner brush drive cavities 76 formed between the lower housing 24 and the upper housing 26 along the sides of the foot assembly 14. Each corner agitator assembly 68 comprises a corner brush pulley 74 detachably mounted to a corner brush support 70 having a plurality of bristles 72 attached thereto. The bristles 72 extend radially from the corner brush support 70 and towards the surface to be cleaned to agitate the surface to be cleaned. Each corner agitator assembly 68 is rotatably mounted on a corner brush bearing 104 projecting upward from the lower housing 24 in a forward end of the respective brush drive cavity 76. In particular, the corner brush support 70 and the corresponding corner brush pulley 74 are brought into contact from opposite sides of the corner brush bearing 104 and snap-fit together. Alternatively, the corner brush support 70 and the corresponding corner brush pulley 74 can be joined together by a welding process or separate mechanical fasteners. The corner brush supports 70 and the corner brush pulleys 74 are joined such that rotation of the latter induces rotation of the former.

With continued reference to FIGS. 3 and 7, each wheel 30 is mounted to a wheel axle 79 that extends into the foot assembly 14 between wheel axle bearings 98 of the upper and lower housings 26, 24. Each wheel axle 79 supports a wheel pulley 78 inside the foot assembly 14 such that rotation of the wheels 30 induces rotation of the wheel pulleys 78. A pair of corner brush belts 80, each one wrapped around one of the wheel pulleys 78 and one of the corner brush pulleys 74, transfers rotation movement of the wheel pulleys 78 into rotational movement of the corner brush supports 70 about a generally vertical axis. The corner brush belts 80 reside in and are movable within the corner brush cavities 76.

Figure 9A:
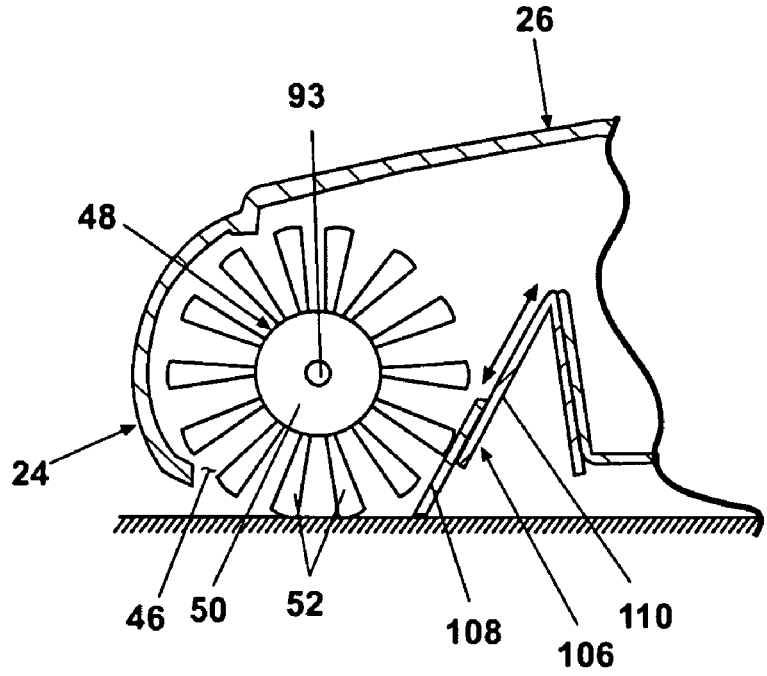
FIG. 9A is a schematic sectional view of the sweeper taken along line 9-9 of FIG. 1 and illustrating a retractable ramp positioned behind the agitator assembly.
Figure 9B:
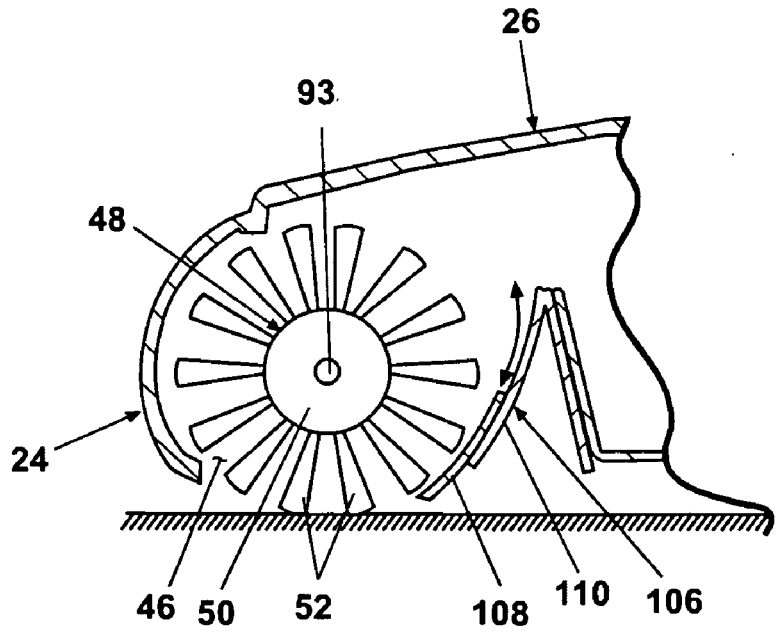
FIG. 9B is a schematic sectional view similar to FIG. 9A and illustrating an alternative retractable ramp.

Referring to FIGS. 8 and 9A, the lower housing 24 supports a ramp assembly 106 located laterally along a rearward edge of the agitator aperture 46. The ramp assembly 106 comprises a retractable ramp 108 and a fixed ramp 110. The retractable ramp 108, which is preferably made of a resilient material, is moveably mounted to the lower housing 24 by a pair of guides (not shown) integrally molded to side walls of the lower 24 housing on both sides of the agitator aperture 46 so that the retractable ramp 108 floats within the guides. In a preferred embodiment, both the retractable ramp 108 and the fixed ramp 110 are generally planar. In an alternate embodiment, which is illustrated in FIG. 9B, both the fixed ramp 110 and the retractable ramp 108 are arcuately shaped. In operation, the retractable ramp 108 is in constant contact with the surface to be cleaned and moves within the guides to maintain contact, regardless of surface conditions or the direction of travel of the sweeper 10. However, the retractable ramp 108 is adapted to collect dirt and debris when the sweeper moves in a forward direction (to the left in FIGS. 9A and 9B) and merely glides over the surface to be cleaned when the sweeper moves in a reverse direction.

In an alternate embodiment, the wheels 30 are coupled to the retractable ramp 108 via a commonly known geared or belt and pulley arrangement to urge or bias the retractable ramp 108 towards the surface to be cleaned to a first, extended position when the powered sweeper 10 moves in a forward direction whereby the agitator aperture 46 leads the dust bin 32. In the first position, the retractable ramp 108 contacts the surface to be cleaned and helps to collect debris in the vicinity of the agitator aperture 46. When the powered sweeper 10 moves in a rearward direction with the dust bin 32 leading the agitator aperture 46, the retractable ramp 108 rides up along the fixed ramp 110 to a second, retracted position, wherein the retractable ramp 108 is spaced from the surface to be cleaned so that debris can pass under the retractable ramp 108 and into the agitator aperture 46.

Referring now to FIG. 8, the lower housing 24 includes an arcuate pivot cradle 100 centrally located in a rearward portion thereof to rotatably receive the lower handle assembly 18. A pivot detent ramp 102 extending longitudinally along the pivot cradle 100 divides the pivot cradle 100 into an arcuate forward portion 100A and an arcuate rearward portion 100B. The pivot cradle 100 in the lower housing 24 is aligned with the pivot recess 38 in the upper housing 26 for mounting the handle assembly 12 to the foot assembly 14.

Figure 10:
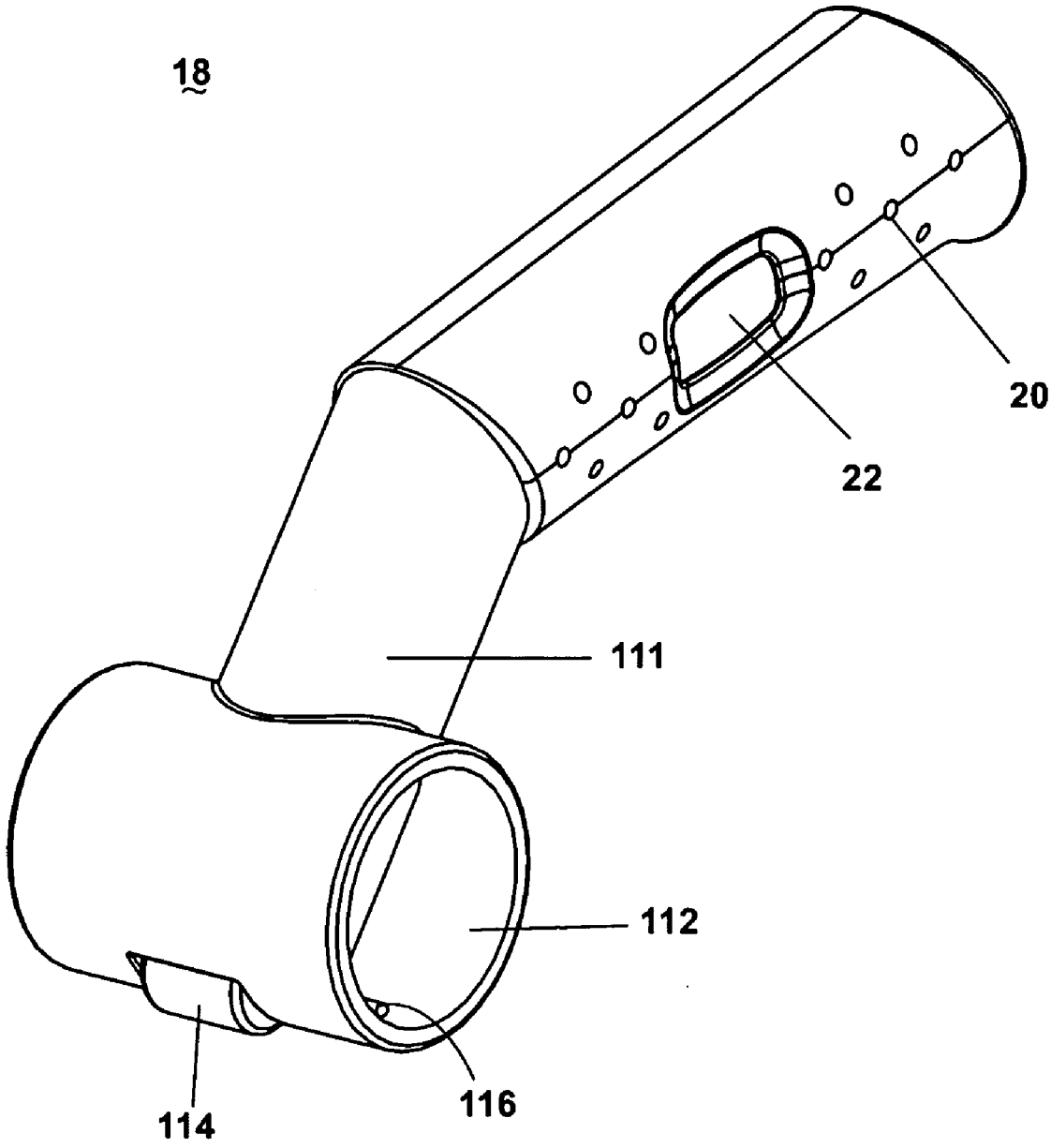
FIG. 10 is a perspective view of a lower handle assembly from the sweeper shown in FIG. 1.
Figure 11:
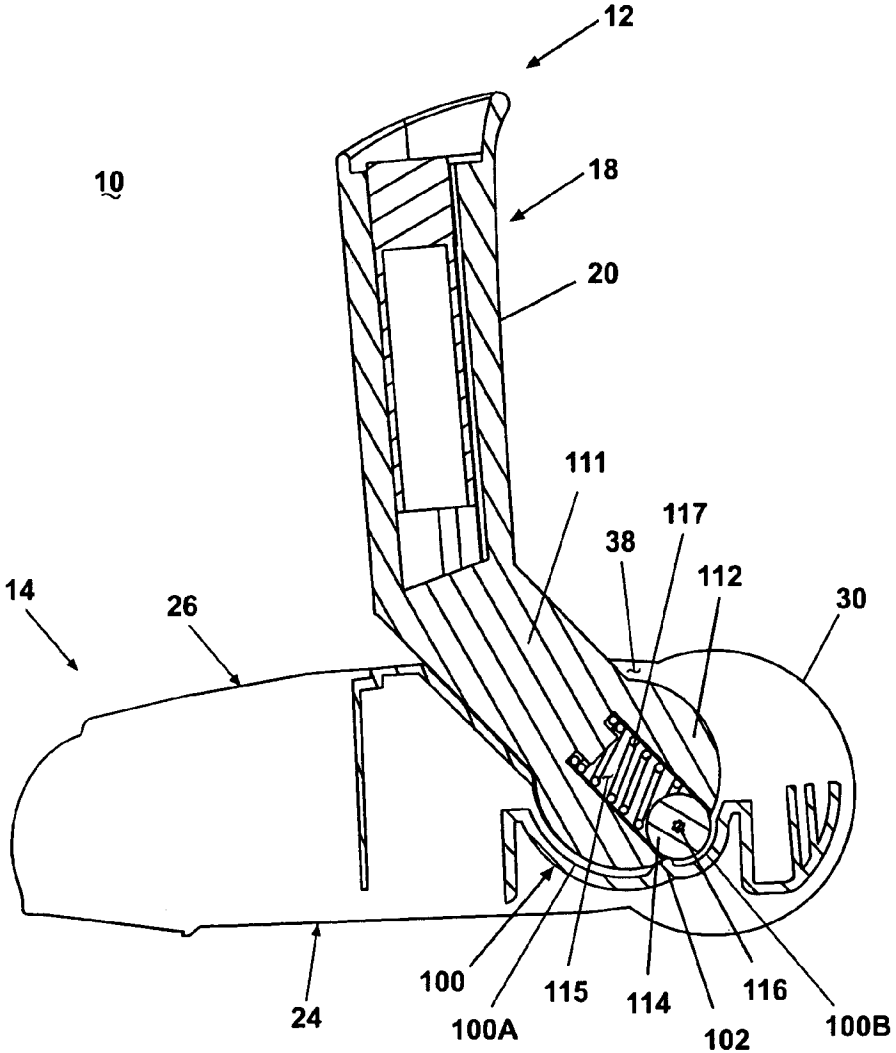
FIG. 11 is a schematic sectional view of the sweeper taken along line 11-11 of FIG. 1.

As shown in FIGS. 10 and 11, the lower handle assembly 18 further comprises a lower section 111 oriented at an obtuse angle relative to the grip 20, and the lower section 111 terminates in a generally cylindrical pivot 112 oriented orthogonal to the lower section 111. The pivot 112 is shaped such that it can be seated in and rotate relative to the pivot cradle 100. Further, the pivot 112 has a cavity 115 that is generally coaxial with the lower section 111 and houses a detent spring 117. The detent spring 117 abuts the end of the cavity 115 at one end and a detent roller 114 at an opposite end. The detent roller 114 is affixed to a detent axle 116 that resides in a central longitudinal slot through the detent roller 114. The detent axle 116, which defines a generally horizontal rotation axis for the detent roller 114, is captured in a corresponding slot (not shown) in the pivot 112 to rotatably mount the detent roller 114 to the lower handle assembly 18. The detent spring 117 biases the detent roller 114 in a direction out of the cavity 115 and towards the pivot cradle 100. The pivot axle 116 limits movement of the detent roller 114 out of the cavity 115; therefore, only a portion of the detent roller 114 projects from the pivot 112. At least one of the detent axle 116 and the corresponding slot in the pivot 112 is designed to accommodate retraction of the detent roller 114 into the cavity 115 when an external force is applied to the detent roller 114 against the bias of the detent spring 117.

Figure 12:
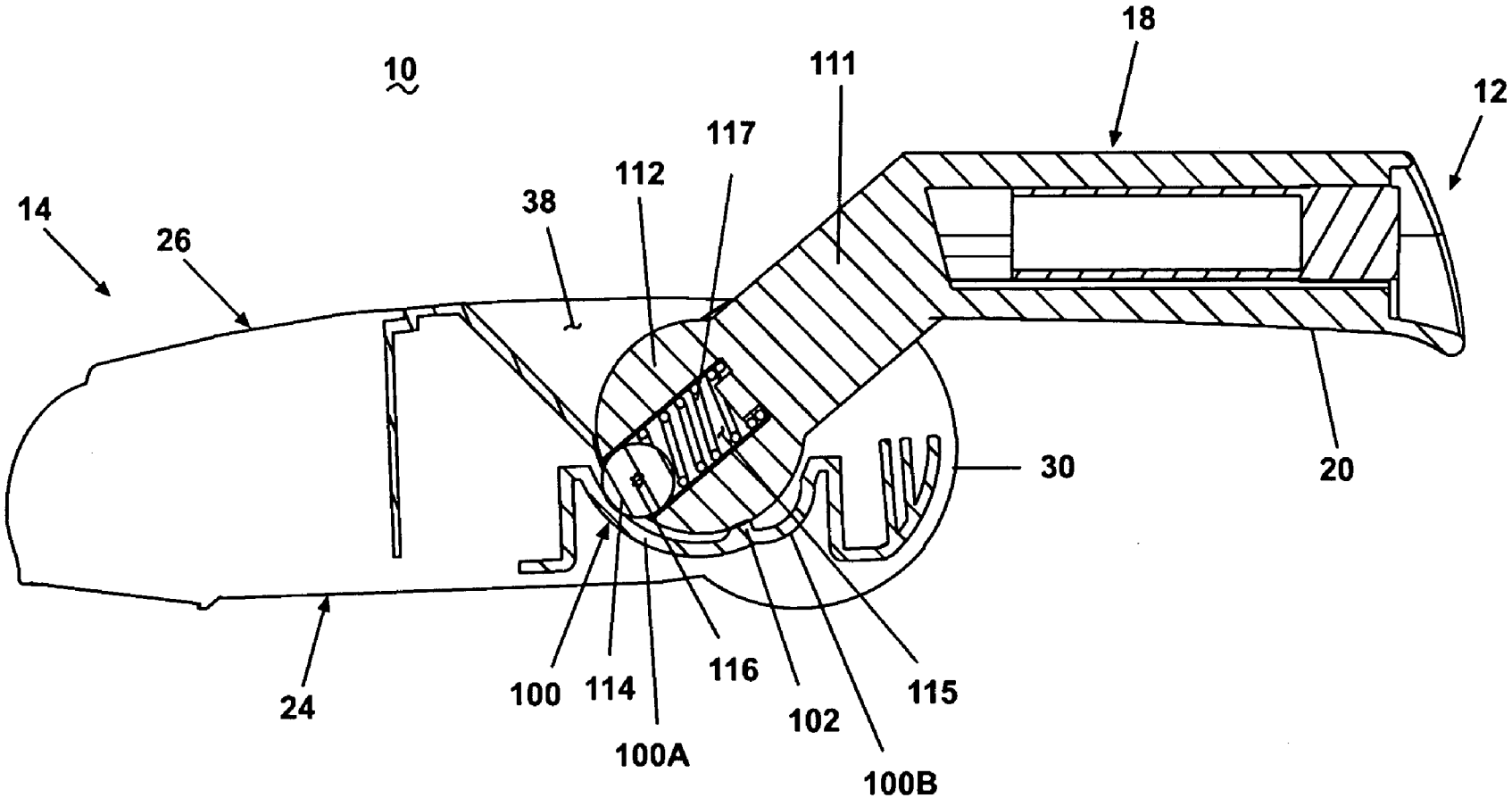
FIG. 12 is a schematic sectional view of the sweeper taken along line 12-12 of FIG. 2.

Referring now to FIGS. 11 and 12, the pivot 112 sits on the pivot cradle 100, and the lower section 111 extends upward through the pivot recess 38 in the upper housing 26. As shown in FIG. 11, when the handle assembly 12 is in the upright position, the detent roller 114 is located in the rearward portion 100B of the pivot cradle 100 and is held therein by the detent ramp 102. The detent ramp 102 abuts the detent roller 114 to prevent the detent roller 114 from moving into the forward portion 100A and thereby maintain the lower handle assembly 18 in the vertical position. When the handle assembly 12 is in the upright position, the obtuse angle between the lower section 111 and the grip 20 locates the handle assembly 12 vertically near the middle of the foot assembly 14. In addition, a forward surface of the lower section 111 makes contact with a forward portion of the pivot recess 38 and acts as a mechanical stop to prevent the handle from moving past the upright position towards the forward position. While the geometry of the obtuse angle on the lower handle assembly 18 provides inherent stability to the sweeper 10 with the handle assembly 12 in the upright position, the detent roller 114 when seated in the rearward portion 100B adds structural rigidity and provides the user with an audible and tactile indication that the handle assembly 12 is properly positioned in the upright position.

To move the lower handle assembly 18 to the horizontal position from the vertical position, the user rotates the grip 20 of the lower handle assembly 18 rearward. As a result of this force applied by the user, the detent roller 114 rides up the detent ramp 102, which pushes the detent roller 114 into the cavity 115 against the bias of the detent spring 117 while the detent pin 116 moves, bends, or otherwise accommodates movement of the detent roller 114. Because the detent roller 114 retracts into the cavity 115, the pivot 112 can rotate clockwise, relative to the orientation of FIGS. 11 and 12, to a position where the detent roller 114 is located in the forward portion 100A of the pivot cradle 100. After the detent roller 114 passes the detent ramp 102, the detent spring 117 returns the detent roller 114 to the position where it partially protrudes from the pivot 112 and the lower handle assembly 18 can rotate along the forward portion 100A of the pivot cradle 100. The lower handle assembly 18 can be rotated to any position desired by the user, including the horizontal position shown in FIG. 12. The obtuse angle between the lower section 111 and the lower grip 20 provides an offset whereby clearance for the user's hand is provided between the lower grip 20 and the surface to be cleaned when the lower handle assembly 18 is in the horizontal position. Preferably, the pivot cradle 100 or at least one of the upper and lower housings 26, 24 includes a stop to prevent movement of the lower handle assembly 18 beyond the horizontal position. To return the lower handle assembly 18 to the vertical position, the user rotates the grip 20 forward so that the detent roller 114 abuts the detent ramp 102 and retracts into the cavity 115 as described above so that the detent roller 114 can pass the detent ramp 102, which thereafter retains the detent roller 114 in the rearward portion 100B of the pivot cradle 100.

An exemplary description of the operation of the powered sweeper 10 follows. It will be appreciated by one of ordinary skill that the operation can proceed in any logical order and is not limited to the sequence presented below. The following description is for illustrative purposes only and is not intended to limit the scope of the invention in any manner.

In operation, the user connects the electrical power transformer and power cord to the charger jack 44 to charge the battery pack 62. Once the battery pack 62 is sufficiently charged, the electrical power transformer and power cord is disconnected from the charging jack 44. The handle assembly 12, with the upper handle segments 16 (if the powered sweeper is used in the upright mode) or without the upper handle segments 16 (if the powered sweeper is used in the hand-held mode), is rotated in a generally rearward direction from the vertical storage position in the manner described above so that the handle assembly 12 is oriented at an acute angle relative to the surface to be cleaned. The user then depresses the switch cover 45 to close the electrical switch 66 and establish electrical communication between the battery pack 62 and the brush motor 58. The brush motor 58 rotates the main shaft 59 and the brush drive gear 82, which thereby turns the brush drive belt 84. The brush drive belt 84 induces rotation of the clutch gear assembly 56 and, ultimately, spins the brush dowel 50 and the bristles 52 in the agitator aperture 46. The dust bin inlet aperture 130 is in fluid communication with the agitator aperture 46, and the agitator assembly 48 throws debris from the surface to be cleaned rearwardly and upwardly along the ramp assembly 106 and into the dust bin 32 through the dust bin inlet aperture 130. The arcuate wall section 126 directs the debris to either side of the dust chamber 118, and the debris collects on the floor 120 of the dust bin 32. Further, as the user moves the foot assembly 14 in a forward or rearward direction, the wheels 30 rotate the wheel axles 79 and wheel pulleys 78, which move the corner brush belts 80. The corner brush belts 80 induce rotation of the corner brush assemblies 68, and the corner brush bristles 72 rotate to throw debris towards and in front of the foot assembly 14, where it can be picked up by the agitator assembly 48 as previously discussed. When sweeping is complete, the user depresses the switch cover 45 to open the electrical switch 66 and stop current flow to the brush motor 58 from the battery pack 62. Rotation of the agitator assembly 48 ceases and the user pivots the lower handle assembly 18 to the vertical storage position wherein the detent roller 114 resides in the rearward portion 100B of the pivot cradle 100 behind the detent ramp 102 as described above.

While the invention has been specifically described in connection with certain specific embodiments thereof, it is to be understood that this is by way of illustration and not of limitation. Reasonable variation and modification are possible within the foregoing disclose and drawings without departing from the spirit of the invention which is embodied in the appended claims.

What is claimed is:

1. A sweeper comprising:

a foot housing that forms a dust bin cavity and an agitator aperture in a bottom portion of the foot housing and that opens toward the surface to be cleaned;

a dust bin mounted in the dust bin cavity and having a dust bin inlet in communication with the agitator aperture;

an agitator rotatably mounted to the foot housing and positioned at least partially in the agitator aperture to throw dirt from the surface to be cleaned into the dust bin through the dust bin inlet;

a motor mounted in the foot housing and coupled to the agitator to rotate the agitator; and a clutch assembly mounted to the agitator and comprising:

a pulley coupled to the motor for rotation therewith;

a clutch coupled to the agitator for rotation therewith, the clutch and the pulley having complementary surfaces, wherein the complementary surfaces comprise ramped slip clutch surfaces; and a biasing member positioned between the clutch and the agitator to bias the clutch towards the pulley to mate the complementary surfaces whereby, during normal operation conditions, rotation of the pulley by the motor rotates the clutch and the agitator as the complementary surfaces of the pulley and the clutch mate and rotate together and, during conditions where rotation of the agitator is prevented, the surface of the clutch slips relative to the complementary surface of the pulley while the motor rotates the pulley, the pulley pushes the clutch against the bias of the biasing member, and the biasing member continues to bias the clutch towards the pulley.

2. The sweeper according to claim 1 wherein the agitator comprises a brush roll rotatably mounted on a horizontally oriented axle, and the clutch assembly is rotatably mounted on the axle adjacent the agitator.

3. The sweeper according to claim 2 wherein the motor comprises a drive shaft with a drive gear fixedly mounted to the drive shaft, and the drive gear is coupled to the pulley by a belt.

4. The sweeper according to claim 3 wherein the motor is powered by a battery.

5. The sweeper according to claim 1 wherein the complementary surfaces comprise multiple ramped surfaces.

6. The sweeper according to claim 5 wherein the multiple ramped surfaces are arranged circumferentially around the pulley and the clutch.

* * * * *